US005346376A

United States Patent [19]

Bookbinder et al.

[11] Patent Number: 5,346,376

[45] Date of Patent: Sep. 13, 1994

[54] AXIAL THRUST APPLYING STRUCTURE FOR THE SCROLLS OF A SCROLL TYPE COMPRESSOR

[75] Inventors: Mark J. Bookbinder, Detroit, Mich.; Christopher M. Bellinger, Lockport; Michael E. Daniels, Depew, both of N.Y.

[73] Assignee: General Motors Corporation, Detroit, Mich.

[21] Appl. No.: 109,197

[22] Filed: Aug. 20, 1993

[51] Int. Cl.[5] ..... F04C 18/04; F04C 27/00

[52] U.S. Cl. ..... 418/55.4; 418/55.5; 418/57

[58] Field of Search ..... 418/55.4, 55.5, 57

[56] References Cited

U.S. PATENT DOCUMENTS

| | | | |
|---|---|---|---|
| 2,809,779 | 10/1957 | Girvin | 418/55.3 |
| 2,841,089 | 7/1958 | Jones | 418/55.5 |
| 3,125,032 | 3/1964 | Smith | 418/57 |
| 3,473,728 | 10/1969 | Vulliez | 418/59 |
| 3,802,809 | 4/1974 | Vulliez | 418/5 |
| 3,874,827 | 4/1975 | Young | 418/57 |
| 3,924,977 | 12/1975 | McCullough | 418/55.5 |
| 4,300,875 | 11/1981 | Fischer et al. | 418/55.5 |
| 4,696,630 | 9/1987 | Sakata et al. | 418/57 |
| 4,764,096 | 8/1988 | Sawai et al. | 418/57 |
| 4,767,293 | 8/1988 | Caillat et al. | 418/55.5 |
| 4,795,323 | 1/1989 | Lessie | 418/55.3 |
| 4,838,773 | 6/1989 | Noburu | 418/57 |
| 4,840,549 | 6/1989 | Morishita et al. | 418/57 |
| 4,846,639 | 7/1989 | Morishita et al. | 418/57 |
| 4,861,245 | 8/1989 | Tojo et al. | 418/57 |
| 4,874,302 | 10/1989 | Kobayashi et al. | 418/55.6 |
| 4,886,433 | 12/1989 | Maier | 418/58 |
| 4,892,469 | 1/1990 | McCullough et al. | 418/57 |
| 4,927,339 | 5/1990 | Riffe et al. | 418/57 |
| 5,156,539 | 10/1992 | Anderson et al. | 418/55.5 |
| 5,192,202 | 3/1993 | Lee | 418/55.5 |
| 5,257,920 | 11/1993 | Takeda | 418/55.5 |

FOREIGN PATENT DOCUMENTS

| | | | |
|---|---|---|---|
| 4-5490 | 1/1992 | Japan | 418/55.5 |

*Primary Examiner*—John J. Vrablik
*Attorney, Agent, or Firm*—Patrick M. Griffin

[57] ABSTRACT

A scroll type compressor 10 having a housing 12, a non-orbital scroll 24 mounted in the rear casing of the housing 12 and an orbital scroll 22. The scrolls 22 and 24 cooperate to form fluid pockets 46 and 48. An orbital drive 50 orbits the orbital scroll 22 to move the fluid pockets 46 and 48 to the center of the scrolls and compress the fluid sealed in the pockets. An anti-rotation assembly 54 is connected to the housing 12 and to the orbital scroll 22 to prevent rotation and permit orbital movement of the orbital scroll. An axial thrust load assembly 56 including a baffle plate 114 with continuous pressure chamber flanges 120 and 122 are mounted in the rear section 16 of the housing 12. The flanges 120 and 122 are telescopically received in grooves 124 and 126 in the end plate 28 of the non-orbital scroll 24. V-shaped spring seals 130 are placed in the grooves 124 and 126. High pressure fluid in the inner discharge chamber and medium pressure which enters toroidal intermediate pressure chamber 138 through passage 140 exert an axial force on the scrolls. The non-orbital scroll 24 is mounted on fixed pins 134 which allow axial movement of the scroll. Springs 144 axially bias the non-orbital scroll 24 toward the orbital scroll 22.

3 Claims, 6 Drawing Sheets

AXIAL THRUST APPLYING STRUCTURE FOR THE SCROLLS OF A SCROLL TYPE COMPRESSOR

TECHNICAL FIELD

The invention relates to a scroll type compressor with an orbital scroll and a non-orbital scroll and more particularly to an assembly for applying an axial thrust load to the scrolls that is sufficient to limit leakage from a high pressure fluid pocket in the scroll assembly to a fluid pocket at a lower pressure, while minimizing wear on the scrolls and the axial seals.

BACKGROUND OF THE INVENTION

Scroll compressors have orbital scrolls which are driven in a generally circular orbit. These orbital scrolls include a plate with a flat surface that is perpendicular to a rotation axis and an involute wrap integral with the plate and extending out from the flat surface. A non-rotatable scroll including a plate with a flat surface that is parallel to the flat surface of the orbital scroll and an involute wrap integral with the plate and extending out from the flat surface cooperates with the orbital scroll to form at least a pair of fluid pockets. The fluid pockets are bound by adjacent surfaces of the wraps, line contacts between the wraps and contact between the axial tips of the wraps and the flat surface of the adjacent scroll. A seal is normally provided in a groove in the axial tip of each scroll wrap to seal between the wrap and the flat surface of the adjacent scroll. Axial tip seals are provided to accommodate thermal expansion of the scroll end plates and the scroll wraps.

The orbital scroll is driven to cause the contact lines between the wraps to move along the surface of the wraps toward the center of the scrolls. As the contact lines move, the fluid pockets move toward the center of the scrolls, the pockets become smaller and the fluid in the pockets is compressed. A fluid outlet aperture is provided in the center portion of one of the scrolls.

The compressed fluid in the scroll pockets exerts an axial force on the parallel flat surfaces of the scroll end plates. This force tends to separate the scrolls and cause leakage of compressed fluid between the axial tips of the scroll wraps and the flat surface of the adjacent scroll. The force of compressed fluid also tends to distort the scroll end plates with flat surfaces. The distortion results from the fact that the. radial outer edges of the scroll plates are at compressor inlet pressure and the center of the scrolls is at the higher compressor outlet pressure.

The scrolls in some compressors are subject to a continuous axial thrust load which is sufficient to hold the scrolls together when operating at maximum output pressure and minimum inlet pressure. The scrolls in these compressors have excessive axial thrust loads on the scrolls at every operating speed and outlet pressure but the designed maximums. This results in excessive and unnecessary wear on compressor parts including seals, scrolls and orbital scroll drives. It also results in excessive power requirements and reduced efficiency due to heat generation.

Scroll type compressors have been built, for stationary refrigeration systems, which employ fluid at compressor outlet pressure to apply an axial thrust load to the center portion of the backside of a scroll plate and subject the radially outer portion of the scroll plate back side to fluid at compressor inlet pressure. It is even known to apply axial thrust loads to a portion of a scroll between the center and the radially outer edge by bleeding fluid from fluid pockets at an intermediate pressure into a toroidal chamber on the back side of the scroll plate. Such a system limits axial thrust loads on the scrolls to a minimum at all operating speeds and conditions, reduces wear and power requirements to a minimum, reduces scroll distortion due to uneven loading and increases compressor life. Unfortunately past systems of this type are expensive to manufacture, difficult to assemble and too large for use on mobil machines.

SUMMARY OF THE INVENTION

An object of this invention to provide an ideal axial thrust load to the scrolls of a scroll type compressor.

Another object of the invention is to provide a compact, easy to assemble and inexpensive structure for applying an ideal axial thrust load to the scrolls of a scroll type compressor.

A further object of the invention is to provide a scroll compressor with a non-orbital scroll that moves axially to accommodate thermal expansion and to thereby allow the axial tips of the scroll wraps to be in continuous sealing contact with the flat surfaces of adjacent scroll end plates.

The scroll type compressor of this invention includes a non-orbital scroll and an orbital scroll mounted inside a housing. The scrolls include end plates with parallel flat surfaces and involute wraps which cooperate to form pairs of fluid pockets. An orbital scroll drive assembly is journaled in the housing for rotation about a rotation axis and connected to the orbital scroll. Anti-rotation assembly prevents rotation of the orbital scroll relative to the housing and permits limited orbital movement. As the drive means propels the orbital scroll, fluid pockets formed by contacts between scroll wraps and end plates move toward the center of the scrolls, the fluid pockets decrease in volume and the fluid in the fluid pockets is compressed. A fluid discharge aperture is provided in the center of the non-orbital scroll for the passage of compressed fluid out of the scrolls.

The scroll compressor housing includes a rear casing with a rear wall and side walls. The rear wall includes a continuous flange which acts as side walls of an exhaust chamber. A straight flat baffle plate is secured to the free flat edge of the continuous flange. A gasket is positioned between the continuous flange and the straight flat baffle plate. A baffle plate discharge opening is provided near the center of the baffle plate for the passage of compressed fluid into the exhaust chamber. A compressor discharge port is provided in the rear casing for the delivery of compressed fluid from the exhaust chamber in the compressor housing.

The front side of the baffle plate includes a first continuous pressure chamber flange and a second continuous pressure chamber flange. The wall surfaces of the two pressure chamber flanges are parallel to the rotation axis of the orbital scroll. The non-orbital scroll end plate has grooves cut in its rear side that can telescopically receive the first and second pressure chamber flanges. Spring seals which can accommodate limited axial movement of the non-orbital scroll are placed in grooves in the non-orbital scroll end plate to provide a seal between the edges of the first and second pressure chamber flanges and the scroll end plate. One seal that can be used is a spring seal with a v-shaped cross section.

The non-orbital scroll is mounted on pins extending from the rear wall of the rear casing. The pins are parallel to the rotation axis, are telescopically received in bores in the non-orbital scroll, and allow axial movement of the scroll while preventing movement in other directions.

The first pressure chamber flange on the baffle plate cooperates with the non-orbital scroll to form an inner discharge chamber filled with fluid at discharge pressure. The second pressure chamber flange on the baffle plate cooperates with the non-orbital scroll and the first pressure chamber flange to form a toroidal intermediate pressure chamber. A passage through the scroll plate allows the passage of fluid at an intermediate pressure into the intermediate chamber. The portion of the nonorbital scroll plate that is radially outside the second pressure chamber flange is inside the compressor inlet chamber and is at inlet pressure.

The scroll type compressor of this invention applies an axial thrust load on the central portion of a scroll that is proportional to the outlet pressure of fluid discharged through a passage at the center of the scrolls. The axial thrust load on the intermediate portion of the scroll plate is proportional to the pressure of fluid in the fluid pockets in the intermediate portion of the scrolls. The axial thrust load on the radially outer portion of the non-orbital scroll is applied by fluid at inlet pressure and is substantially the same as the pressure of fluid in fluid pockets at the radially outer portion of the scrolls.

During operation of the compressor the axial thrust load applied to the non-orbital scroll is generally proportional to the pressure in the scroll pockets and changes with changes in the pressure of fluid in the scroll fluid pockets. The compressor is easy to assemble, and the assembly providing axial thrust loads on the scrolls is inexpensive to manufacture.

The foregoing and other objects, features and advantages of the present invention will become more apparent in the light of the following detailed description of exemplary embodiments thereof, as illustrated in the accompanying drawing.

DESCRIPTION OF THE DRAWING FIGURES

BEST MODE FOR CARRYING OUT THE INVENTION

Figure 1:
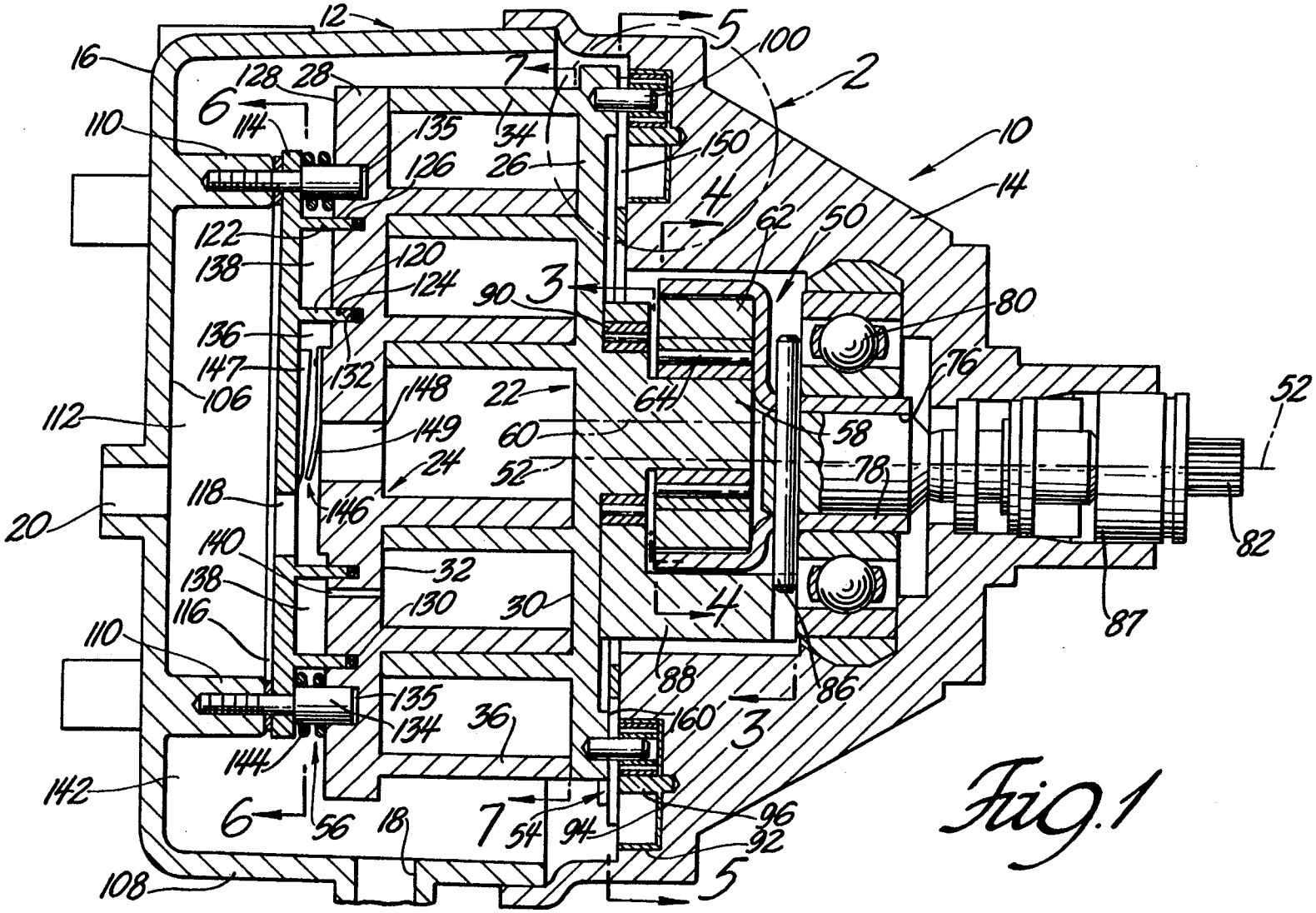
FIG. 1 is a vertical sectional view, with certain parts broken, of a scroll compressor embodying the invention.

The scroll compressor 10, as shown in FIG. 1 includes a compressor housing 12 with a front casing 14 and a rear casing 16. A fluid inlet 18 and a fluid outlet 20 are provided in the housing 12.

Figure 7:
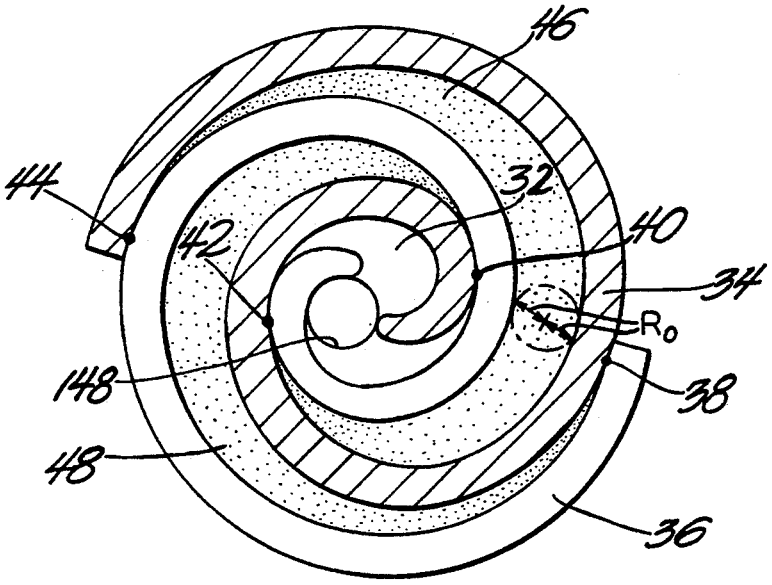
FIG. 7 is a sectional view of the scrolls taken along lines 7—7 of FIG. 1.

An orbital scroll 22 and a non-orbital scroll 24 are mounted within the housing 12. The scrolls 22 and 24 include end plates 26 and 28 with parallel flat surfaces 30 and 32 and involute wraps 34 and 36. The involute wraps 34 and 36 contact each other along contact lines 38, 40, 42 and 44 and the adjacent flat surface 30 and 32 to form closed fluid pockets 46 and 48 shown in FIG. 7.

The scroll drive assembly 50 includes an orbiting stub shaft 58 that is an integral part of the orbital scroll 22. An axial thrust load assembly 56 is mounted in the rear casing 16 of the compressor housing 12 for applying an axial thrust load to the non-orbital scroll 24 that is proportional to the load applied by compressed fluid in the fluid pockets 46 and 48.

Figure 2:
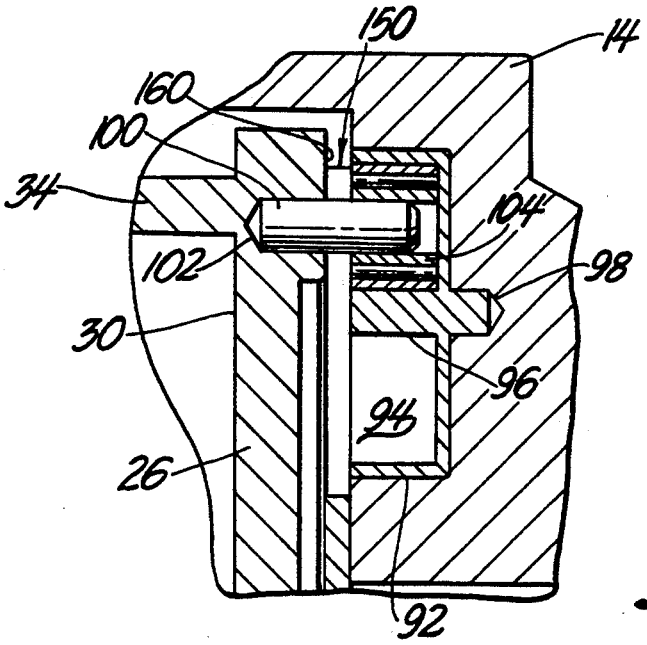
FIG. 2 is an enlarged sectional view of a portion of the orbital scroll anti-rotation assembly shown at 2 in FIG. 1.
Figure 3:
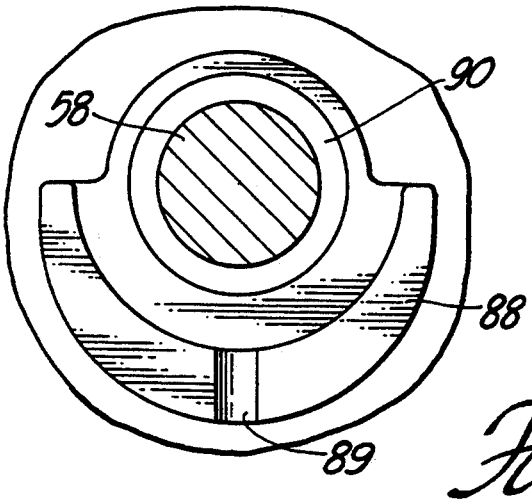
FIG. 3 is an enlarged end view of the inertial balance weight and a portion of the orbital scroll taken along lines 3—3 of FIG. 1.
Figure 4:
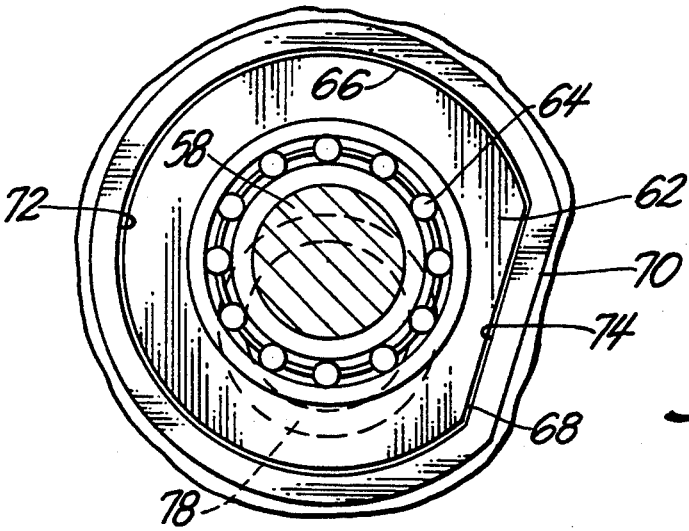
FIG. 4 is an enlarged sectional view of the orbital scroll stub shaft, the sliding block bushing and the drawn steel cup taken along lines 4—4 of FIG. 1.
Figure 5:
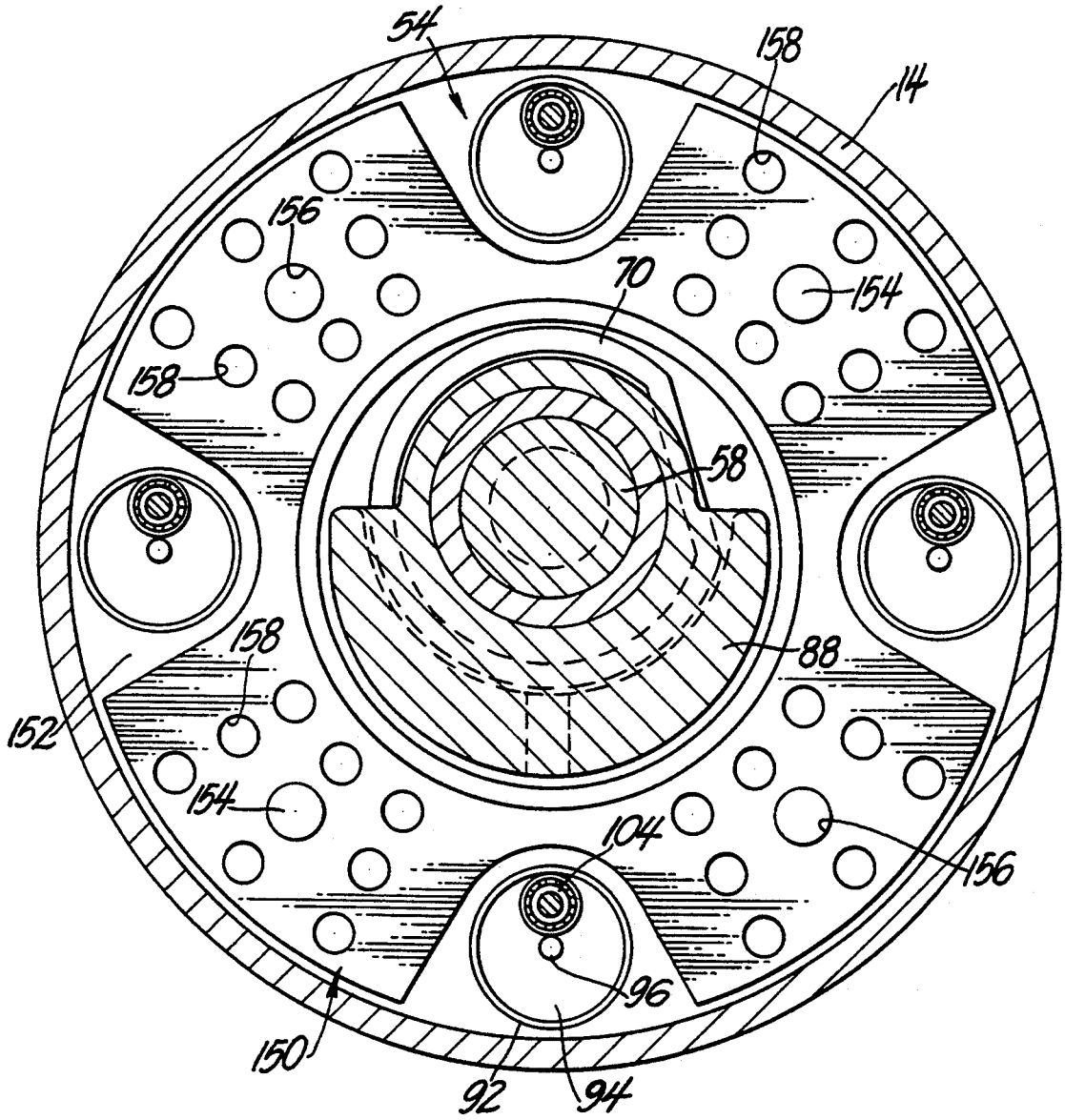
FIG. 5 is a sectional view of the thrust washer and the orbital scroll anti-rotation assembly taken along lines 5—5 of FIG. 1.
Figure 6:
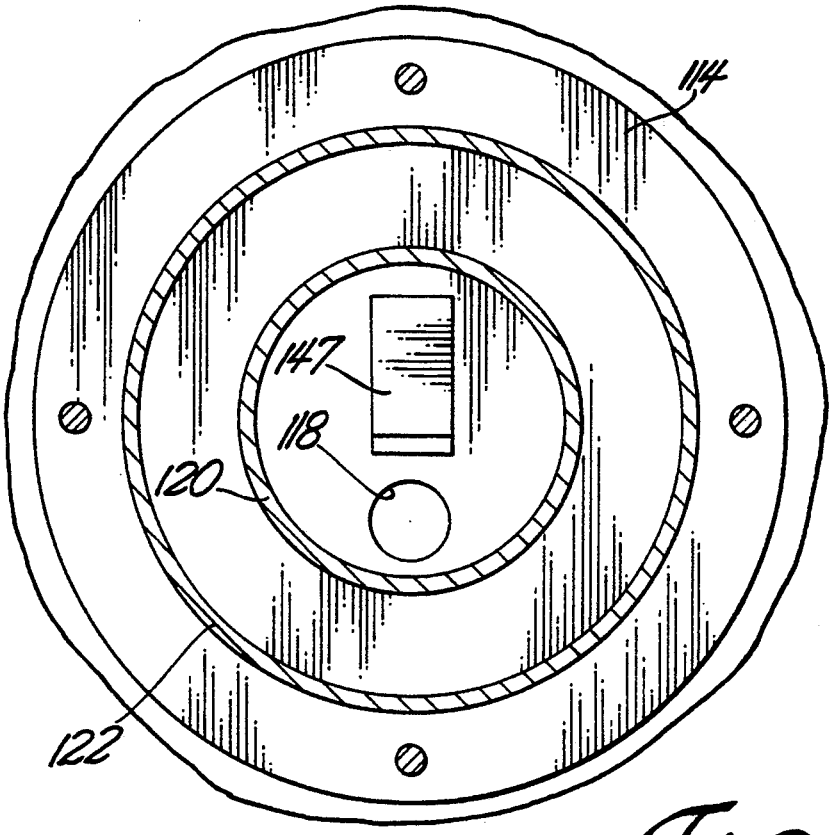
FIG. 6 is a sectional view of a portion of the axial thrust load assembly taken along lines 6—6 of FIG. 1.

The scroll drive assembly 50 is rotatably journaled in the front casing 14 for rotation about the rotation axis 52. An anti-rotation assembly 54, shown in FIG. 2, is mounted in the front casing 14 to prevent rotation and allow orbital movement of the orbital scroll 22 in a circular orbit with a radius $R_o$. An axial thrust load assembly 56 is mounted in the rear casing 16 of the compressor housing 12 for applying an axial thrust load to the scrolls that exceeds the load applied by compressed fluid in the fluid pockets 46 and 48.

The scroll drive assembly 50 includes an orbiting stub shaft 58 that is an integral part of the orbital scroll 22. The centerline 60 of the orbital scroll stub shaft 58 is offset, from the rotation axis 52 a distance equal to the radius of the orbit $R_o$ of the orbital scroll 22. A sliding block bushing 62 is rotatably secured to the stub shaft 58 by a needle bearing 64. The outer edge surface 66 of the sliding block bushing 62 is concentric with the center line 60 of the orbital scroll orbiting stub shaft 58 except for a flat area 68.

A drawn steel cup 70 with a first bore 72 and a flat surface 74 slides over the sliding block bushing 62. The sliding block bushing 62 is slightly smaller than the first bore 72 and the flat surface 74 of the drawn steel cup 70. This clearance allows the sliding block bushing 62 to slide radially in and out to increase or decrease the orbit radius of the orbital scroll 22 to accommodate imperfections in the scroll wrap surfaces. This permits the orbital scroll involute wrap 34 to maintain contact with the involute wrap 36 on the non-orbital scroll 24 and to accommodate imperfections in the shape of wrap surfaces. The clearance also allows a decrease in the orbit radius to accommodate some foreign materials on wrap surfaces. The flat surface 74 in the drawn steel cup 70 contacts the flat area 68 on the sliding block bushing 62 to rotate the sliding block bushing.

The drawn steel cup 70 includes a second bore 76 concentric with the rotation axis 52 that is parallel to and offset from the centerline 60 of the first bore 72 a distance equal to the radius of the orbital scroll 22 orbit. The second bore 76 is defined by a tubular portion 78 that is rotatably journaled in the front casing 14 by a bearing 80 for rotation about an axis that is concentric with the rotation axis 52. A drive shaft 82 is received in the second bore 76 of the drawn steel cup 70. A bearing 87 rotatably journals the drive shaft 82 in the front casing 14 for rotation about an axis that is concentric with the rotation axis 52 of the compressor 10. A pin 86 passes through aligned apertures in the tubular portion 78 of the drawn steel cup 70 and through the drive shaft 82 to lock the two parts together. The free end of the drive shaft 82 extends out of the front casing 14 of the compressor housing 12 so that it can be driven by a power source.

An inertial balance weight 88 is rotatably journaled on the orbital scroll orbiting stub shaft 58 by a needle bearing 90, between the orbital scroll end plate 26 and the sliding block bushing 62. The balance weight 88 is driven by the pin 86 which engages a slot 89 in the balance weight and passes through a hole in the drive shaft 82. The axial location of the center of gravity of the inertial balance weight 88 near the center of gravity of the orbital scroll 22 and the center of gravity of the drawn steel cup 70 reduces the bending loads on the orbital and rotating parts.

The anti-rotation assembly 54 includes four bores 92 in the front casing 14, spaced from the rotation axis 52 and opening toward the orbital scroll 22. A cup 94 is pressed into each bore 92 and a pin 96 is pressed through an opening in the center of each cup 94 and into a bore 98 in the center of each bore 92. The pin 96 could be an integral part of the cup 94, if desired. The pins 96 and the cups 94 cooperate to form a circular track. Pins 100 are pressed into each of the four apertures 102 in the end plate 26 for the orbital scroll 22. A needle bearing 104 is pressed onto the end of each pin 100. Each needle bearing 104 orbits in a circle defined by the toroidal passage inside of the cup 94 and around the pin 96. The four cups 94 and needle bearings 104 prevent rotation of the orbital scroll 22 and allow orbital movement. The inside diameter of each cup 94 is slightly oversized to allow for changes in the radius of the orbital scroll 22 orbit when the sliding block bushing 62 slides in the drawn steel cup 70.

The axial thrust load assembly 56 includes the rear casing 16 with a rear wall 106 and side walls 108. The rear wall 106 includes a continuous flange 110 which acts as side walls of an exhaust chamber 112. A straight flat baffle plate 114 is secured to the free flat edge of the continuous flange 110. A gasket 116 is positioned between the continuous flange 110 and the straight flat baffle plate 114. A baffle plate discharge opening 118 is provided near the center of the baffle plate 114 for the passage of compressed fluid into the exhaust chamber 112.

The front side of the straight flat baffle plate 114 includes a first continuous pressure chamber flange 120 and a second continuous pressure chamber flange 122. The wall surfaces of the two pressure chamber flanges 120 and 122 are parallel to the rotation axis 52. The non-orbital scroll end plate 28 has grooves 124 and 126 cut in its rear surface 128 that can telescopically receive the first and second continuous pressure chamber flanges 120 and 122. Spring seals 130 with a v-shaped cross section are placed in grooves 124 and 126 in the non-orbital scroll end plate 28 to provide a seal between the edges 132 of the first and second continuous pressure chamber flanges 120 and 122 and the scroll end plate 28. The spring seals 130 accommodate limited axial movement of the non-orbital scroll 24 relative to the straight flat baffle plate 114.

The non-orbital scroll is mounted on pins 134 extending from the rear wall 106 of the rear casing 16. The pins 134 are parallel to the rotation axis 52, are telescopically received in bores 135 in the end plate 28 of the non-orbital scroll 24, and allow axial movement of the non-orbital scroll while preventing movement in other directions.

The first pressure chamber flange 120 on the straight flat baffle plate 114 cooperates with the nonorbital scroll to form an inner discharge chamber 136 filled with fluid at discharge pressure. The second continuous pressure chamber flange 122 on the straight flat baffle plate 114 cooperates with the non-orbital scroll 24 and the first continuous pressure chamber flange 120 to form a toroidal intermediate pressure chamber 138. A passage 140 through the scroll end plate 28 allows the passage of fluid, at an intermediate pressure, into the toroidal intermediate pressure chamber 138. The portion of the end plate 28, of the non-orbital scroll 24, that is radially outside the second pressure chamber flange 122, is at compressor housing 12 inlet pressure.

The pins 134 include threaded portions that screw into the continuous flange 110 on the rear wall 106 of the rear casing 16. The pins 134 thus perform the dual functions of holding the baffle plate 114 and the gasket 116 in sealing engagement with the continuous flange 110 and at the same time guiding and restraining the nonorbital scroll 24. Coil compression springs 144 are provided on the pins 134 to bias the non-orbital scroll 24 toward the orbital scroll 22. These springs 144 insure that the scrolls 22 and 24 will compress fluid during start up when there is no fluid pressure in the inner discharge chamber 136 or in the toroidal intermediate pressure chamber 138 to provide an axial thrust load on the end plate 28 of the non-orbital scroll 24.

Figure 8:
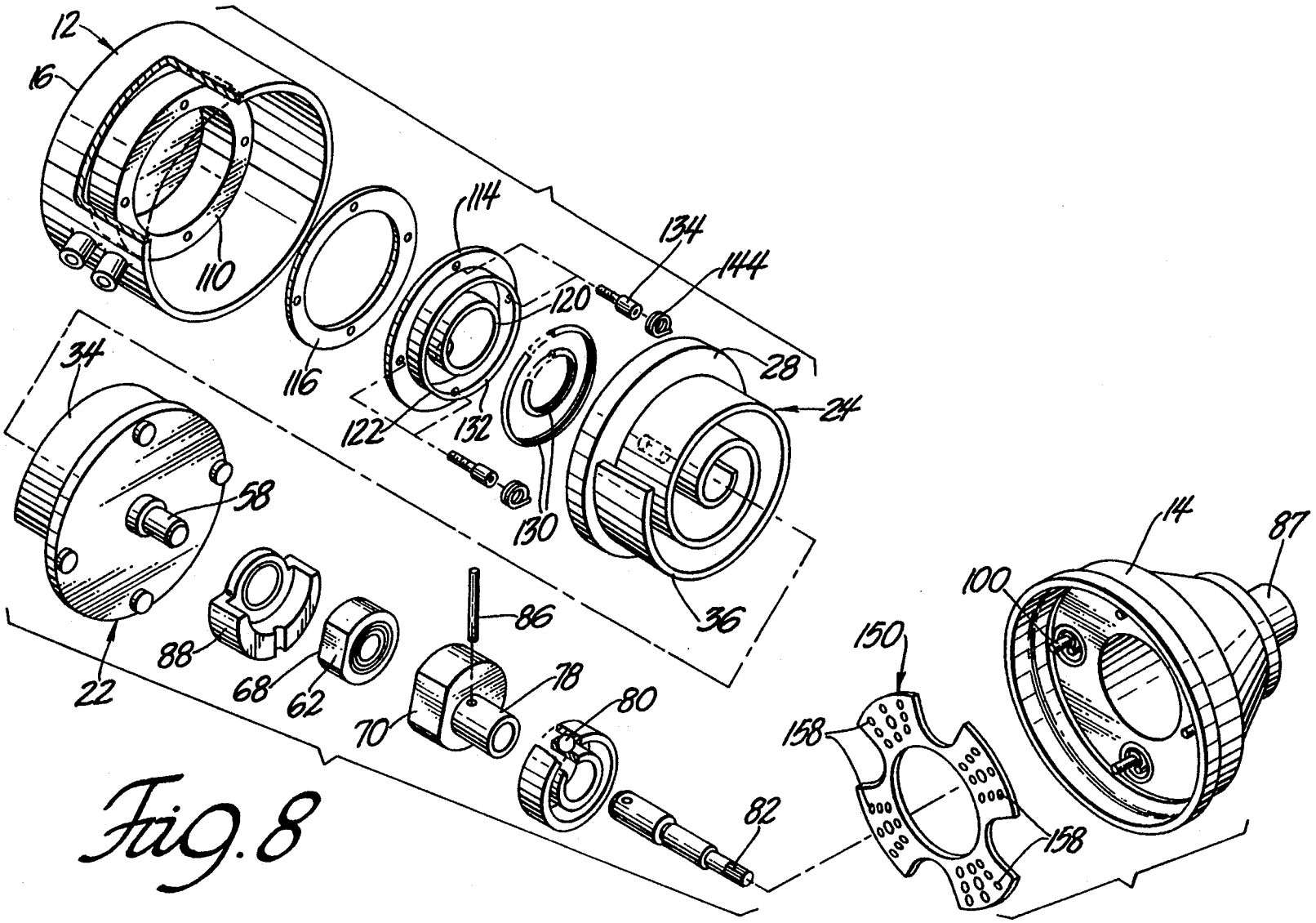
FIG. 8 is an exploded view reduced in size of the major working parts of the scroll compressor.
Figure 9:
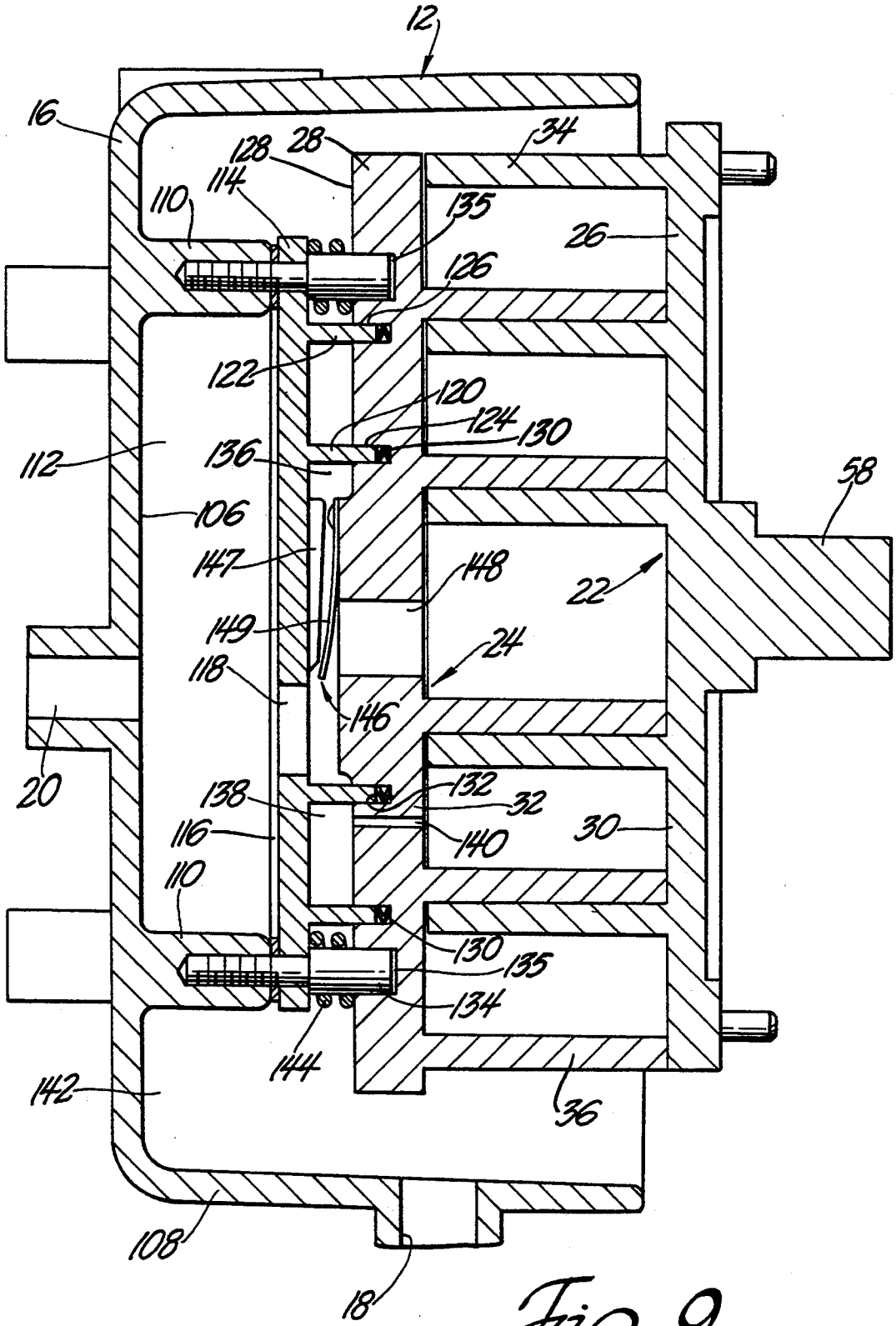
FIG. 9 is an enlarged vertical sectional view of the scrolls and the axial thrust load applying structure.

The axial thrust load assembly 56 allows the nonorbital scroll 24 to move axially to accommodate thermal expansion of the end plates 26 and 28 and the involute wraps 34 and 36 of the orbital scroll 22 and the nonorbital scroll 24. By allowing axial movement of the nonorbital scroll 24 to accommodate thermal expansion, the axial tips of the involute wrap 36 can be in continuous contact with the flat surface 30 on the end plate 26 and the axial tips of the involute wrap 34 can be in continuous contact with the flat surface 32 on the end plate 28. The axial movement of the non-orbital scroll 24 accommodates thermal expansion due to fluid temperature increases during fluid compression and eliminates the need for axial tip seals that float in tip seal grooves in scroll wraps to accommodate thermal expansion of scroll wraps. No axial tip seals are shown in the involute wraps 34 and 36 as shown in FIGS. 1, 8 and 9. However, axial tip seals can still be used if desired to improve compressor efficiency, and to accommodate the differences in thermal expansion between the radially inner ends of the involute wraps 34 and 36 where temperatures are highest during compressor operation and at the radially outer ends of the involute wraps where temperatures are lowest during compressor operation. Axial tip seals can also be used, if desired, to reduce wear and to improve sealing between axial tips of involute wraps 34 and 36 and flat surfaces 30 and 32 on end plates 26 and 28, due to manufacturing variations.

A reed type check valve 146 is commonly employed to prevent compressed fluid from flowing back into the scrolls through the outlet passage 148. The reed type check valve 146 is shown mounted on the back side of the end plate 28 of the non-orbital scroll 24. The reed type check valve 146 could also be located on the straight flat baffle plate 114 or even outside the compressor housing 12. A ramp 147 on the baffle plate 114 limits movement of the reed 149.

A thrust washer 150 is mounted on the rear surface 152 of the front casing 14. Pins 154 are pressed through apertures 156 through the thrust washer 150 and into apertures in the front casing 14. Additional apertures 158 are provided in the thrust washer 150 to provide pockets for washer lubricant. The thrust washer 150 is preferably made from or coated with a low friction material. A flat surface 160 on the front side of the end plate 26 of the orbital scroll 22 contacts the thrust washer 150 to limit axial movement of the orbital scroll. During operation of the compressor 10, the flat surface 160 on the front of the orbital scroll 22 slides along the surface of the thrust washer 150.

The invention has been described in detail in connection with preferred embodiments, which are for exemplification only. It will be understood by those skilled in the art that modifications to the described embodiments can be made that are within the scope of the invention.

We claim:

1. A scroll type compressor including a housing with a front section and a rear section; a fluid inlet in the housing; a fluid outlet in the housing; a non-orbital scroll including an end plate, a spiral wrap and an outlet passage through a central portion of the end plate mounted in the rear section of the housing by a mounting assembly which permits axial movement of the non-orbital scroll relative to the housing; an orbital scroll including an end plate and a spiral wrap mounted in the front portion of the housing and cooperating with the non-orbital scroll to form at least one pair of fluid pockets; a scroll drive to drive the orbital scroll in an orbital path; an anti rotation assembly to prevent rotation of the orbital scroll while permitting orbital movement; and an axial thrust load assembly including a baffle plate mounted in the rear section of the housing, a first pressure chamber flange integral with the baffle plate and extending forwardly toward the scrolls, a second pressure chamber flange integral with the baffle plate, extending forwardly toward the scrolls and surrounding the first pressure chamber flange grooves in the end plate of the non-orbital scroll telescopically receiving the first pressure chamber flange and the second pressure chamber flange and a resilient seal in each groove for sealing between the end plate of the non-orbital scroll and the forward edges of the first and second pressure chamber flanges operable to maintain sealing during axial movement of the non-orbital scroll within the compressor housing, a passage through the end plate of the non-orbital scroll between the first and second pressure chamber flanges, and wherein the first pressure chamber flange surrounds the outlet passage.

2. A scroll type compressor including a housing with a front section and a rear section; a fluid inlet in the housing; a fluid outlet in the housing; a non-orbital scroll including an end plate, a spiral wrap and an outlet passage through a central portion of the end plate, mounted in the rear section of the housing by a mounting assembly including a plurality of pins extending forwardly from the rear section of the housing and telescopically received in bores in the end plate of the non-orbital scroll; an orbital scroll including an end plate and a spiral wrap, mounted in the front portion of the housing and cooperating with the non-orbital scroll to form at least one pair of fluid pockets; a scroll drive to drive the orbital scroll in an orbital path; an anti-rotation assembly to prevent rotation of the orbital scroll while permitting orbital movement; and an axial thrust load assembly including a baffle plate mounted in the rear section of the housing, a first pressure chamber flange integral with the baffle plate and extending forwardly toward the scrolls, a second pressure chamber flange integral with the baffle plate and extending forwardly toward the scrolls and surrounding the first pressure chamber flange, grooves in the end plate of the non-orbital scroll telescopically receiving the first pressure chamber flange and the second pressure chamber flange and a spring seal in each groove for sealing between the end plate of the non-orbital scroll and the forward edges of the first and second pressure chamber flanges operable to maintain sealing during limited movement of the non-orbital scroll axially within the compressor housing, a passage through the end plate of the non-orbital scroll between the first and second pressure chamber flanges, and wherein the first pressure chamber flange surrounds the outlet passage.

3. A scroll type compressor including a housing with a front section and a rear section; a fluid inlet in the housing; a fluid outlet in the housing; a non-orbital scroll including an end plate, a spiral wrap and an outlet passage through a central portion of the end plate, mounted in the rear section of the housing by a mounting assembly including a plurality of pins extending forwardly from the rear section of the housing and telescopically received in bores in the end plate of the non-orbital scroll; an orbital scroll including an end plate and a spiral wrap, mounted in the front portion of the housing and cooperating with the non-orbital scroll to form at least one pair of fluid pockets; a thrust washer between the end plate of the orbital scroll and a rear surface of the front section of the housing to transmit axial loads on the orbital scroll to the housing; a scroll drive to drive the orbital scroll in an orbital path; an anti-rotation assembly to prevent rotation of the orbital scroll while permitting orbital movement; and an axial thrust load assembly including a baffle plate mounted in the rear section of the housing, a first pressure chamber flange integral with the baffle plate and extending forwardly toward the scrolls, a second pressure chamber flange integral with the baffle plate and extending forwardly toward the scrolls and surrounding the first pressure chamber flange, grooves in the end plate of the non-orbital scroll telescopically receiving the first pressure chamber flange and the second pressure chamber flange and a spring seal in each groove for sealing between the end plate of the non-orbital scroll and the forward edges of the first and second pressure chamber flange, operable to maintain sealing during limited movement of the non-orbital scroll axially within the compressor housing, a passage through the end plate of the non-orbital scroll between the first and second pressure chamber flanges, and wherein the first pressure chamber flange surrounds the outlet passage.

* * * * *